US009644167B2

(12) United States Patent
Gieselman et al.

(10) Patent No.: US 9,644,167 B2
(45) **Date of Patent: *May 9, 2017**

(54) LUBRICATING COMPOSITIONS CONTAINING A CARBOXYLIC FUNCTIONALISED POLYMER AND DISPERSANT

(71) Applicant: The Lubrizol Corporation, Wickliffe, OH (US)

(72) Inventors: Matthew D. Gieselman, Wickliffe, OH (US); John K. Pudelski, Cleveland Heights, OH (US); Mary Galic Raguz, Mentor, OH (US); Thomas S. Derevjanik, Mentor-on-the-Lake, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/951,690

(22) Filed: Nov. 25, 2015

(65) Prior Publication Data

US 2016/0075966 A1 Mar. 17, 2016

Related U.S. Application Data

(63) Continuation of application No. 13/947,171, filed on Jul. 22, 2013, which is a continuation of application No. 13/202,647, filed as application No. PCT/US2010/025133 on Feb. 24, 2010, now Pat. No. 8,569,217.

(Continued)

(51) Int. Cl.

| | |
|---|---|
| ***C10M 161/00*** | (2006.01) |
| ***C10M 133/12*** | (2006.01) |
| ***C10M 149/12*** | (2006.01) |
| ***C10M 133/44*** | (2006.01) |
| *C10M 159/12* | (2006.01) |

(Continued)

(52) U.S. Cl.

CPC ..... *C10M 161/00* (2013.01); *C10M 133/12* (2013.01); *C10M 133/44* (2013.01); *C10M 149/12* (2013.01); *C10M 129/26* (2013.01); *C10M 133/16* (2013.01); *C10M 133/38* (2013.01); *C10M 149/02* (2013.01); *C10M 159/12* (2013.01); *C10M 2205/022* (2013.01); *C10M 2205/04* (2013.01); *C10M 2205/06* (2013.01); *C10M 2207/026* (2013.01); *C10M 2207/028* (2013.01); *C10M 2207/24* (2013.01); *C10M 2207/26* (2013.01); *C10M 2207/262* (2013.01); *C10M 2207/281* (2013.01); *C10M 2207/283* (2013.01); *C10M 2215/064* (2013.01); *C10M 2215/066* (2013.01); *C10M 2215/067* (2013.01); *C10M 2215/08* (2013.01); *C10M 2215/086* (2013.01); *C10M 2215/28* (2013.01); *C10M 2217/06* (2013.01); *C10M 2219/022* (2013.01); *C10M 2219/046* (2013.01); *C10M 2223/045* (2013.01); *C10M 2223/049* (2013.01); *C10N 2230/02* (2013.01); *C10N 2230/041* (2013.01); *C10N 2230/10* (2013.01); *C10N 2230/36* (2013.01); *C10N 2230/42* (2013.01); *C10N 2230/43* (2013.01); *C10N 2230/45* (2013.01); *C10N 2240/10* (2013.01)

(58) Field of Classification Search

CPC ..... C10M 2205/022; C10M 2205/028; C10M 2205/04; C10M 2205/024; C10M 2209/086; C10M 129/26; C10M 133/16; C10M 133/38; C10M 149/02; C10M 149/12; C10M 159/12; C10M 161/00; C10M 133/12; C10M 2223/04; C10M 2215/067; C10M 2223/049; C10M 2207/24; C10M 2215/086; C10M 2205/06; C10M 2207/281; C10M 2207/26; C10M 2215/28; C10M 2207/026; C10M 2219/046; C10M 2207/283; C10M 2219/022; C10M 2207/262; C10M 2217/06; C10M 2207/028; C10M 2215/08; C10N 2230/45; C10N 2230/041; C10N 2230/43; C10N 2230/42; C10N 2230/10; C10N 2230/36; C10N 2230/02; C10N 2240/10

See application file for complete search history.

(56) References Cited

U.S. PATENT DOCUMENTS

| | | | |
|---|---|---|---|
| 4,234,435 | A | 11/1980 | Meinhardt et al. |
| 4,863,623 | A | 9/1989 | Nalesnik |

(Continued)

FOREIGN PATENT DOCUMENTS

| | | |
|---|---|---|
| EP | 1574559 | 9/2005 |
| GB | 768701 | 2/1957 |

(Continued)

OTHER PUBLICATIONS

Corresponding International Publication No. 2010/099136 A1 and Search Report published Sep. 2, 2010.

(Continued)

*Primary Examiner* — Taiwo Oladapo

(74) *Attorney, Agent, or Firm* — Deron A. Cook, Esq.; Teresan W. Gilbert, Esq.

(57) ABSTRACT

The invention provides an oil of lubricating viscosity, a dispersant and an amine-functionalized additive, wherein the amine-functionalized additive is derived from an amine having at least 3 or 4 aromatic groups. The invention further relates to the use of the lubricating composition in an internal combustion engine.

15 Claims, No Drawings

Related U.S. Application Data

(60) Provisional application No. 61/155,718, filed on Feb. 26, 2009.

(51) Int. Cl.

| | |
|---|---|
| *C10M 129/26* | (2006.01) |
| *C10M 133/16* | (2006.01) |
| *C10M 133/38* | (2006.01) |
| *C10M 149/02* | (2006.01) |

(56) References Cited

U.S. PATENT DOCUMENTS

| | | | | |
|---|---|---|---|---|
| 5,182,041 | A | 1/1993 | Benfarmeo et al. | |
| 5,264,140 | A | 11/1993 | Mishra et al. | |
| 5,356,999 | A | 10/1994 | Kapuscinski et al. | |
| 5,409,623 | A | 4/1995 | Mishra et al. | |
| 6,107,257 | A * | 8/2000 | Valcho | C08F 255/00 508/221 |
| 6,107,258 | A * | 8/2000 | Esche, Jr. | C08F 255/02 508/231 |
| 6,117,825 | A | 9/2000 | Liu et al. | |
| 7,361,629 | B2 | 4/2008 | Loper et al. | |
| 2005/0202980 | A1 * | 9/2005 | Loper | C10L 1/221 508/232 |
| 2008/0171678 | A1 | 7/2008 | Loper et al. | |

FOREIGN PATENT DOCUMENTS

| | | |
|---|---|---|
| WO | 2006015130 | 2/2006 |
| WO | 2008016967 | 2/2008 |
| WO | 2009064685 | 5/2009 |

OTHER PUBLICATIONS

Written Opinion of corresponding International Application No. PCT/US2010/025133 mailed May 4, 2010.

* cited by examiner

LUBRICATING COMPOSITIONS CONTAINING A CARBOXYLIC FUNCTIONALISED POLYMER AND DISPERSANT

CROSS-REFERENCE TO RELATED APPLICATION

This application is a continuation application of U.S. Ser. No. 13/947,171 filed on Jul. 22, 2013, which is a continuation application of U.S. Ser. No. 13/202,647 filed on Oct. 27, 2011, which claims priority to provisional application Ser. No. 61/155,718 filed on Feb. 26, 2009.

FIELD OF INVENTION

The invention provides an oil of lubricating viscosity, a dispersant and an amine-functionalised additive, wherein the amine-functionalised additive is derived from an amine having at least 3 or 4 aromatic groups. The invention further relates to the use of the lubricating composition in an internal combustion engine.

BACKGROUND OF THE INVENTION

Engine manufacturers have focused on improving engine design in order to minimise emissions of particulates, emissions of other pollutants, and also improve cleanliness, fuel economy and efficiency. One of the improvements in engine design is the use of exhaust gas recirculation (EGR) engines. Whilst improvements in engine design and operation have contributed to reducing emissions, some engine design advances are believed to have generated other challenges for the lubricant. For example, EGR is believed to have led to increased formation and/or accumulation of soot and sludge.

Soot-mediated oil thickening is common in heavy duty diesel engines. Some diesel engines employ EGR. The soot formed in an EGR engine has different structures and causes increased viscosity of engine lubricant at lower soot levels than formation of soot in the engine without an EGR. Attempts to alleviate soot-mediated oil thickening are disclosed in the references summarised below.

Traditional dispersant viscosity modifiers (DVMs) made from ethylene-propylene copolymers that have been radically grafted with maleic anhydride and reacted with various amines have shown desirable performance to prevent oil thickening in diesel engines. Aromatic amines are said to show good performance in this regard. DVMs of this type are disclosed in, for instance, U.S. Pat. Nos. 4,863,623; 6,107,257; 6,107,258; and 6,117,825.

U.S. Pat. No. 4,863,623 discloses controlling EGR soot by utilising maleic anhydride grafted ethylene-propylene copolymers capped with aromatic amines, such as 4-aminodiphenylamine.

U.S. Pat. No. 5,409,623 discloses functionalised graft copolymers as viscosity index improvers, containing an ethylene alpha-monoolefin copolymer grafted with an ethylenically unsaturated carboxylic acid material and derivatised with an azo-containing aromatic amine compound.

U.S. Pat. No. 5,356,999 discloses multifunctional viscosity index improvers for lubricating oils containing a polymer onto which has been grafted an unsaturated reactive monomer and thereafter reacted with amines containing sulphonamide units. The polymer is either an ethylene-propylene copolymer or an ethylene-propylene-diene terpolymer.

U.S. Pat. No. 5,264,140 discloses an ethylene alpha-monoolefin copolymer grafted with an ethylenically unsaturated carboxylic acid derivatised with an amide-containing aromatic amine material.

International publication WO 06/015130 discloses maleic anhydride grafted ethylene-propylene copolymers capped with sulphonamides, nitroanilines, diaromatic diazocompounds, anilides or phenoxyanilides. The copolymers are useful for controlling EGR soot.

Other dispersant viscosity modifying polymers suitable for lubricants have been contemplated including polyacrylic copolymers, including the disclosure of British Patent GB 768 701.

U.S. Pat. No. 4,234,435 discloses a composition in which a succinated polybutene is condensed with either an alkyl polyamine to make a succinimide dispersant or an alkyl polyol to make a succinic ester dispersant.

U.S. Pat. No. 5,182,041 discloses an additive composition comprising a graft and amine-derivatised polymer having an average molecular weight ranging from about 300 to 3500.

U.S. Pat. No. 7,361,629 and US Patent Application 2008/0171678 both disclose an amination product of a hydrocarbyl substituted succinic acylating agent and a mixture containing an aliphatic polyamine and an aromatic polyamine. The molar ratio of aliphatic polyamine to aromatic polyamine in the mixture ranges from about 10:0.1 to about 0.1:10.

PCT Application PCT U.S. Ser. No. 08/082,944 discloses an isatoic anhydride derived additive for reducing soot-mediated oil thickening and/or sludge formation.

Many of the attempts to alleviate soot-mediated oil thickening are believed to have a detrimental impact on seal performance (for example tensile strength and rupture elongation). The reason is because a number of known lubricant additives often deteriorate resin or rubber seals although they do satisfy lubricating performance requirements. The lubricant additives are believed to be sufficiently reactive that they shrink the seals and/or impair their strength and elasticity. Examples of the seals include resin or rubber seals such as silicone rubber seal, acrylic rubber seal, fluorocarbon resin seal, nitrile rubber seal, hydrogenated nitrile rubber seal and ethylene-propylene rubber seal.

SUMMARY OF THE INVENTION

The inventors of this invention have discovered a lubricating composition that is capable of providing at least one of (i) dispersancy, (ii) cleanliness, (iii) a lubricant with acceptable levels of soot-mediated oil thickening and/or sludge formation, and (iv) a lubricant capable of reducing or preventing any detrimental impact on seal performance. Accordingly, it may also be desirable if an additive were capable of providing dispersant properties, and optionally providing a lubricant with acceptable levels of soot-mediated oil thickening and/or sludge formation. In one embodiment, it would be desirable to provide a lubricant with acceptable levels of soot-mediated oil thickening and/or sludge formation whilst reducing or eliminating a detrimental impact on seal performance. In one embodiment, it would be desirable to provide a lubricant with acceptable levels of dispersancy, acceptable levels of soot-mediated oil thickening and/or sludge formation whilst reducing or preventing any detrimental impact on seal performance (for example tensile strength and rupture elongation).

In one embodiment the invention provides a lubricating composition comprising an oil of lubricating viscosity, a dispersant and an amine-functionalised additive, wherein the amine-functionalised additive may be derived from an amine having at least 3 or 4 aromatic groups.

In one embodiment the invention provides a lubricating composition comprising an oil of lubricating viscosity, a succinimide dispersant and an amine-functionalised additive, wherein the amine-functionalised additive may be derived from an amine having at least 3 or 4 aromatic groups.

In one embodiment the invention provides a lubricating composition comprising an oil of lubricating viscosity, a dispersant and an amine-functionalised additive, wherein the amine-functionalised additive may be derived from an amine having at least 3 or 4 aromatic groups (in particular at least 4 aromatic groups). Typically the amine has at least one —$NH_2$ functional group, and at least 2 secondary or tertiary amino groups.

In one embodiment the invention provides a lubricating composition comprising an oil of lubricating viscosity, a dispersant and an amine-functionalised additive, wherein the amine-functionalised additive may be derived from an amine having at least 3 or 4 aromatic groups obtained/obtainable by a process comprising reacting: (1) isatoic anhydride or alkyl substituted isatoic anhydride and (2) an aromatic amine with at least two aromatic groups and a primary or a reactive secondary amino group. A reactive secondary amino group has no more than one attached aromatic group.

In one embodiment the invention provides a lubricating composition comprising an oil of lubricating viscosity, a dispersant and a product obtained/obtainable by reacting a carboxylic functionalised polymer with an amine having at least 3 or 4 aromatic groups (or at least 4 aromatic groups). Typically the amine has at least one —$NH_2$ functional group, and at least 2 secondary or tertiary amino groups.

In one embodiment the invention provides a lubricating composition comprising an oil of lubricating viscosity, a dispersant and an amine-functionalised additive that is derived from an amine having at least 3 or 4 aromatic groups (or at least 4 aromatic groups). Typically the amine has at least one —$NH_2$ functional group, and at least 2 secondary or tertiary amino groups where the —$NH_2$ group may be condensed with a hydrocarbyl-substituted phenol, (typically an alkylphenol) and an aldehyde in a Mannich reaction to make a covalent attachment of the amine to the hydrocarbyl-substituted phenol.

In one embodiment the invention provides a lubricating composition comprising an oil of lubricating viscosity, a dispersant and a product obtained/obtainable by reacting a carboxylic acid (such as a fatty acid) with an amine having at least 3 aromatic groups (or at least 4 aromatic groups), at least one —$NH_2$ functional group, and at least 2 secondary or tertiary amino groups.

The fatty acid may include dodecanoic acid, decanoic acid, tall oil acid, 10-methyl-tetradecanoic acid, 3-ethyl-hexadecanoic acid, and 8-methyl-octadecanoic acid, palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene, polypropenyl-substituted succinic acid derived from a polypropene, octadecyl-substituted adipic acid, chlorostearic acid, 12-hydroxystearic acid, 9-methylstearic acid, dichlorostearic acid, ricinoleic acid, lesquerellic acid, stearylbenzoic acid, eicosanyl-substituted naphthoic acid, dilauryl-decahydronaphthalene carboxylic acid, 2-propylheptanoic acid, 2-butyloctanoic acid or mixtures thereof. In one embodiment the carboxylic acid may be dodecanoic acid, decanoic acid, tall oil acid, 10-methyl-tetradecanoic acid, 3-ethyl-hexadecanoic acid, and 8-methyl-octadecanoic acid, palmitic acid, stearic acid, myristic acid, oleic acid, linoleic acid, behenic acid or mixtures thereof.

As used herein reference to the amounts of additives present in the lubricating composition disclosed herein are quoted on an oil free basis, i.e., amount of actives.

In one embodiment the invention provides a lubricating composition comprising an oil of lubricating viscosity, a dispersant and an amine-functionalised additive as disclosed herein, wherein the amount of dispersant may be present at 0.05 wt % to 12 wt %, or 0.1 wt % to 10 wt %, or 0.5 wt % to 6 wt %, and wherein the amine-functionalised additive may be present at 0.01 wt % to 12 wt %, or 0.75 wt % to 8 wt %, or 1 wt % to 6 wt %.

In one embodiment the invention provides a lubricating composition comprising an oil of lubricating viscosity, a dispersant and an amine-functionalised additive disclosed above that has been derived from isatoic anhydride or alkyl substituted isatoic anhydride, wherein the amount of dispersant may be present at 0.05 wt % to 12 wt %, or 0.75 wt % to 8 wt %, or 1 wt % to 6 wt %, and wherein the amine-functionalised additive may be present at greater than 1 wt % to 12 wt %, or 1.5 wt % to 8 wt %, or 2 wt % to 6 wt %.

In one embodiment the invention provides a lubricating composition comprising an oil of lubricating viscosity, a dispersant and an amine-functionalised additive as disclosed herein, wherein the amount of dispersant may be present at 0.05 wt % to 12 wt %, or 0.75 wt % to 8 wt %, or 1 wt % to 6 wt %, wherein the amine-functionalised additive disclosed above that has not been derived from isatoic anhydride or alkyl substituted isatoic anhydride may be present at 0.5 wt % to 12 wt %, or 0.75 wt % to 8 wt %, or 1 wt % to 6 wt %.

In one embodiment the invention provides a method of lubricating an internal combustion engine comprising supplying to the internal combustion engine a lubricating composition as disclosed herein.

In one embodiment the invention provides a method of lubricating an internal combustion engine comprising supplying to the internal combustion engine a lubricating composition comprising an oil of lubricating viscosity and an amine-functionalised additive, wherein the amine-functionalised additive may be derived from an amine having at least 3 or 4 aromatic groups (in particular at least 4 aromatic groups), at least one —$NH_2$ functional group, and at least 2 secondary or tertiary amino groups.

In one embodiment the invention provides a method of lubricating an internal combustion engine comprising, supplying to the internal combustion engine a lubricating composition comprising an oil of lubricating viscosity and an amine-functionalised additive disclosed above that has been derived from isatoic anhydride or alkyl substituted isatoic anhydride.

In one embodiment the invention provides for the use of the lubricating composition disclosed herein to alleviate soot-mediated oil thickening and/or sludge formation whilst reducing or preventing any detrimental impact on seal performance.

In one embodiment the invention provides for the use of the lubricating composition disclosed herein to alleviate soot-mediated oil thickening and/or sludge formation whilst reducing or preventing any detrimental impact on seal performance in an internal combustion engine lubricant.

DETAILED DESCRIPTION OF THE INVENTION

The present invention provides a lubricating composition and a method for lubricating an engine as disclosed above.

Dispersant

The dispersant of the present invention may be a succinimide dispersant, or mixtures thereof. In one embodiment the dispersant may be present as a single dispersant. In one embodiment the dispersant may be present in a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be a N-substituted long chain alkenyl succinimide. Examples of N-substituted long chain alkenyl succinimide include polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

There are two commonly employed processes for making succinimide dispersants. These differ in the method by which a polyalkylene (typically polyisobutylene, but also copolymers including ethylene copolymer) substituent is prepared and by which it is affixed to a mono- or diacid or anhydride moiety, especially a succinic anhydride moiety or its reactive equivalent. In a conventional process (a), isobutylene is polymerized in the presence of $AlCl_3$ to produce a mixture of polymers comprising predominantly trisubstituted olefin (III) and tetrasubstituted olefin (IV) end groups, with only a very small amount (for instance, less than 20 percent) of chains containing a terminal vinylidene group (I). In an alternative, "chlorine-free" or "thermal" process (b), isobutylene is polymerized in the presence of $BF_3$ catalyst to produce a mixture of polymers comprising predominantly (for instance, at least 70 percent) terminal vinylidene groups, with smaller amounts of tetrasubstituted end groups and other structures. These materials, sometimes referred to as "high vinylidene PIB," are also described in U.S. Pat. No. 6,165,235, Table 1.

The conventional polyisobutylene of (a) reacts with maleic anhydride in the presence of chlorine by a series of chlorination, dehydrochlorination, and Diels-Alder reactions, more fully described in U.S. Pat. No. 6,165,235, to provide a significant amount of di-succinated polymeric material.

In contrast, high vinylidene polyisobutylene of (b) is believed to react with maleic anhydride in the absence of chlorine by a series of thermal "ene" reactions to produce a mixture of mono- and di-succininated polymeric material.

Preparation of acylating agents from polyisobutylene made from a $BF_3$ process and their reaction with amines is disclosed in U.S. Pat. No. 4,152,499. Similar adducts can be made using polymers other than polyisobutylene; for instance U.S. Pat. No. 5,275,747 discloses derivatized ethylene alpha-olefin polymers with terminal ethenylidene unsaturation which can be substituted with mono- or dicarboxylic acid producing moieties. These materials of component (b) may also contain a small amount of materials with cyclic structure. The cyclic components, however, are predominantly provided by materials from the chlorine route (process (a)) and the non-cyclic components are predominantly provided by materials from the thermal route (process (b)).

The two types of products, described above and also referred to as (a) and (b), are described in this text both in terms of their structure and in terms of their method of manufacture (chlorine versus non-chlorine or thermal process) for the purpose of completeness and clarity in description, and because it to be understood that further investigation may show that the structures depicted may prove to be incomplete or even to some extent incorrect. Nevertheless it is important to recognize that the materials prepared by the chlorine process are different from those prepared by the non-chlorine route, and these differences, whatever they may ultimately prove to be, lead to the performance characteristics of the present invention. For example, it is also believed that the product from the chlorine reaction typically contains a certain percentage of internal succinic functionality, that is, along the backbone of the polymer chain, while such internal succinic functionality is believed to be substantially absent from the non-chlorine material. This difference may also play a role in the performance of the present invention. Applicants do not intend to be bound by any such theoretical explanation.

The hydrocarbyl substituents on each of the succinic anhydride components should normally be of sufficient length to provide a desired degree of solubility in a lubricating oil. Thus, while the length of the hydrocarbyl substituent in component (a) need not be the same as in component (b), each of (a) and (b) will typically be derived from a hydrocarbylene having a number average molecular weight of at least 300, at least 800, or at least 1200, e.g., that of component (a) can be at least 1200. Typical upper limits to the molecular weight may be determined by considerations of solubility, cost, or other practical considerations, and may be up to 5000 or up to 2500. Thus, for instance, the hydrocarbylene from which the hydrocarbyl substituents of components (a) and (b) are derived can independently have a number average molecular weight of 300 to 5000 or 800 to 2500.

Each of the two types of succinated polymeric materials can further react with an amine, an alcohol, or a hydroxyamine, and preferably a polyamine, to form a dispersant. Dispersants of this type generally are well known and are disclosed, for instance, in U.S. Pat. No. 4,235,435 (especially for type (a)) and in U.S. Pat. No. 5,719,108 (especially for type (b)).

In one embodiment the dispersant may be prepared by process described in U.S. Pat. No. 6,165,235. For example the dispersant may be prepared by reacting polyisobutylene succinic anhydride with an alkylene polyamine.

The alkylene polyamine may be an ethylene polyamine, propylene polyamine, butylene polyamine, or mixtures thereof. Typically the polyamine may be an ethylene polyamine, or mixtures thereof. Ethylene polyamines, such as some of those mentioned above, are preferred. They are described in detail under the heading "Diamines and Higher Amines" in Kirk Othmer's "Encyclopedia of Chemical Technology", 4th Edition, Vol. 8, pages 74-108, John Wiley and Sons, N.Y. (1993) and in Meinhardt, et al, U.S. Pat. No. 4,234,435.

Examples of ethylene polyamine include ethylenediamine, diethylenetriamine, triethylenetetramine, tetraethylenepentamine, pentaethylenehexamine, N-(2-aminoethyl)-N'-[2-[(2-aminoethyl)amino]ethyl]-1,2-ethanediamine, alkylene polyamine still bottoms, or mixtures thereof.

The alkylene polyamine bottoms may be characterized as having less than 2%, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex., designated "E-100" has a specific gravity at 15.6° C. of 1.0168, a percent nitrogen by weight of 33.15 and a viscosity at 40° C. of 121 cSt ($mm^2/s$). Gas chromatography analysis of such a sample showed it contains about 0.93% "Light Ends" (most probably diethylenetriamine), 0.72% triethylenetetramine, 21.74% tetraethylene pentamine and 76.61% pentaethylene hexamine and higher (by weight). A similar alkylene polyamine bottoms are commercially sold under as E100™ polyethyleneamines from Dow Chemical.

The polyisobutylene succinic anhydride used in the preparation of the dispersant may be prepared by a method (as described in U.S. Pat. No. 6,165,235) comprising:

(a) forming and heating at a temperature less than 150° C. a mixture comprising a polyisobutylene having number average molecular weight 300-10,000 and 90 mole percent, based on the moles of said polyisobutylene, of tetra- and tri-substituted end groups, and a halogen, said halogen being added to said mixture in a molar amount up to an amount equal to said moles of end groups;

(b) adding to said mixture an α,β-unsaturated acid (typically maleic acid) or an α,β-unsaturated anhydride (typically maleic anhydride) compound sequentially to or simultaneously with addition of said halogen;

(c) increasing the temperature of said mixture from 170° C. to 220° C. and holding the mixture at said temperature for a time sufficient to react said polyisobutylene with said α,β-unsaturated acid or said α,β-unsaturated anhydride compound;

(d) cooling said mixture to less than 200° C. and adding thereto equal molar amounts of said halogen and said α,β-unsaturated acid or said α,β-unsaturated anhydride compound; and (e) increasing the temperature of said mixture to a limit of less than 220° C. and holding at said temperature for a time sufficient to reduce unreacted α,β-unsaturated acid or α,β-unsaturated anhydride compound in said mixture to less than three percent, wherein said method produces a polyisobutylene substituted carboxylic acylating agent having a chlorine content of less than 2,000 parts per million.

The dispersant of U.S. Pat. No. 6,165,235 may be prepared by reacting the polyisobutylene prepared in Example 1 (see column 12, lines 25 to 63), or Example 2 (see column 12, line 64 to column 13, line 13) and an alkylene polyamine such as E100™ polyethyleneamines. For instance the resultant compound may have a maleic anhydride derived units to polyisobutylene ratio of 1:1.3 to 1:1.8, such as 1:1.5. The compound may have a carbonyl to nitrogen ratio of 1:1 to 1:5, or 1:1.3.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % of the lubricating composition.

Amine-Functionalised Additive

The lubricating composition of the invention further contains an amine-functionalised additive. The amine-functionalised additive may be derived from an amine having at least 3 or 4 aromatic groups.

As used herein the term "an aromatic group" is used in the ordinary sense of the term and is known to be defined by Hückel theory of 4n+2 π electrons per ring system. Accordingly, one aromatic group of the invention may have 6, or 10, or 14 π electrons. Hence a benzene ring has 6 π electrons, a naphthylene ring has 10 π electrons and an acridine group has 14 π electrons.

An example of the amine having at least 3 or 4 aromatic groups may be represented by Formula (1):

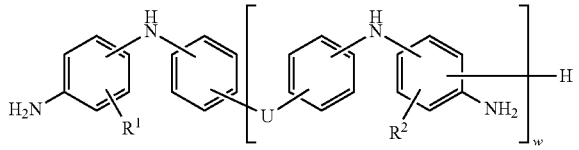

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

An example of the amine having at least 3 or 4 aromatic groups may be represented by Formula (1a):

Formula (1a)

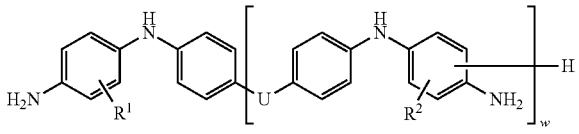

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

Alternatively, the compound of Formula (1a) may also be represented by:

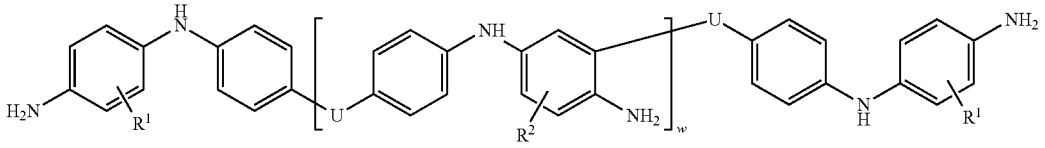

wherein each variable U, $R^1$, and $R^2$ are the same as described above and w is 0 to 9 or 0 to 3 or 0 to 1 (typically 0).

Examples of an amine having at least 3 or 4 aromatic groups may be represented by any of the following Formulae (2) and/or (3):

Formula (2)

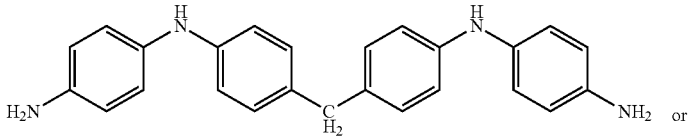

or

Formula (3)

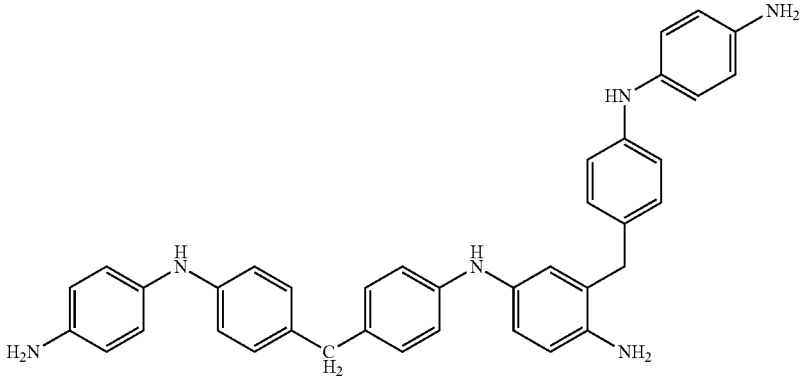

In one embodiment the amine having at least 3 or 4 aromatic groups may include mixtures of compounds represented by the formulae disclosed above. A person skilled in the art will appreciate that compounds of Formulae (2) and (3) may also react with the aldehyde described below to form acridine derivatives. Acridine derivatives that may be formed include compounds illustrated represented by Formula (2a) or (3a) to (3c) below. In addition to these compounds represented these formulae, a person skilled in the art will also appreciate that other acridine structures may be possible where the aldehyde reacts with other with benzyl groups bridged with the >NH group. Examples of acridine structures include those represented by Formulae (2a), (3a) or (3b) or (3c):

Formula (2a)

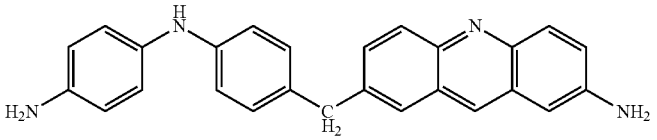

Formula (3a)

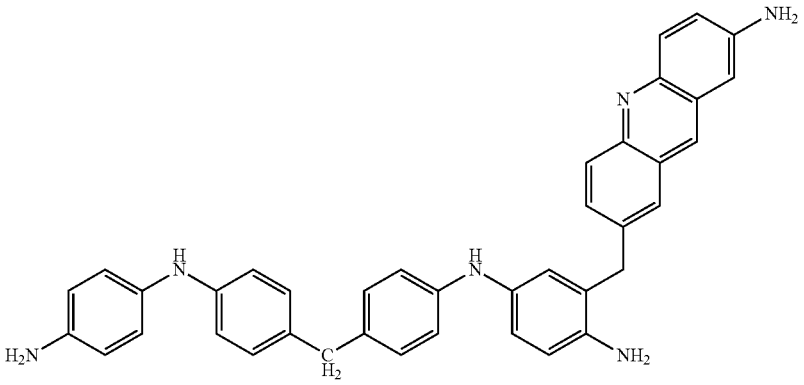

Any or all of the N-bridged aromatic rings are capable of such further condensation and perhaps aromaticisation. One other of many possible structures is shown in Formula (3b).

Formula (3b)

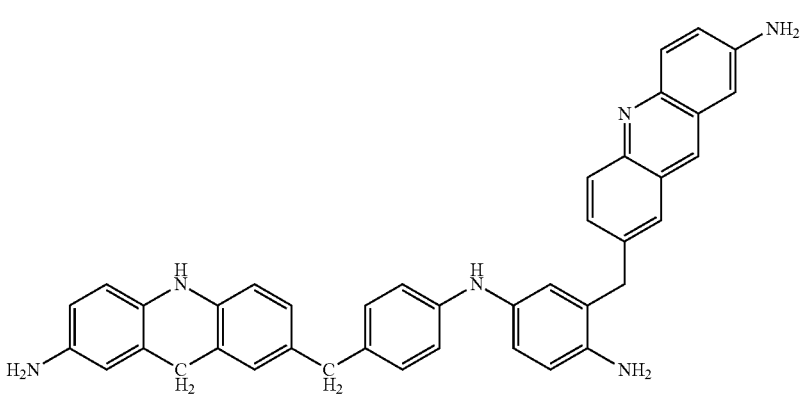

Formula (3c)

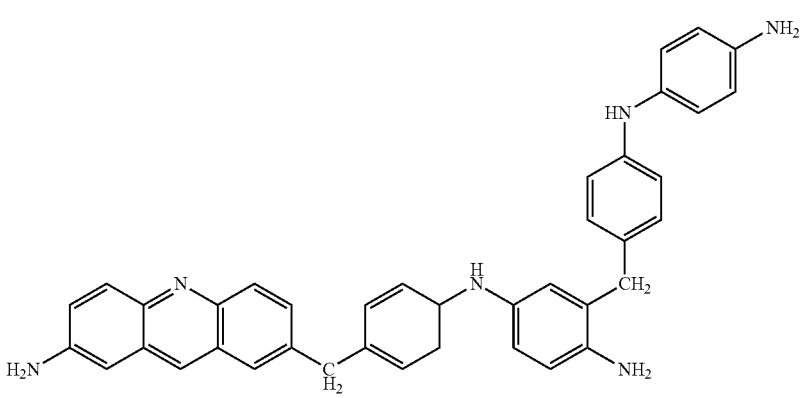

Any of the formulae above (2), (2a) (3), or (3a) to (3c) could also have further condensation reactions occurring resulting in one or more acridine moieties forming per molecule.

Examples of the amine having at least 3 or 4 aromatic groups may be bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine, N-4-{4-[4-(4-amino-phenylamino)-benzyl]-phenyl}-2-[4-(4-amino-phenylamino)-cyclohexa-1,5-dienylmethyl]-benzene-1,4-diamine, N-[4-(7-amino-acridin-2-ylmethyl)-phenyl]-benzene-1,4-diamine, or mixtures thereof.

In one embodiment the amine having at least 3 or 4 aromatic groups may be bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine or mixtures thereof.

The amine having at least 3 or 4 aromatic groups may be prepared by a process comprising reacting an aldehyde with an amine (typically 4-aminodiphenylamine). The resultant amine may be described as an alkylene coupled amine having at least 3 or 4 aromatic groups, at least one —$NH_2$ functional group, and at least 2 secondary or tertiary amino groups.

The aldehyde may be aliphatic, alicyclic or aromatic. The aliphatic aldehyde may be linear or branched. Examples of a suitable aromatic aldehyde include benzaldehyde or o-vanillin. Examples of an aliphatic aldehyde include formaldehyde (or a reactive equivalent thereof such as formalin or paraformaldehyde), ethanal or propanal. Typically the aldehyde may be formaldehyde or benzaldehyde.

Alternatively, the amine having at least 3 or 4 aromatic groups may also be prepared by the methodology described in Berichte der Deutschen Chemischen Gesellschaft (1910), 43, 728-39.

In one embodiment the amine having at least 3 or 4 aromatic groups may be obtained/obtainable by a process comprising reacting isatoic anhydride or alkyl substituted isatoic anhydride, with an aromatic amine with at least two aromatic groups and a reactive primary or secondary amino group. The resultant material may be described as an anthranilic derivative.

In one embodiment the anthranilic derivative may be prepared in a reaction containing isatoic anhydride or alkyl substituted isatoic anhydride and an aromatic amine selected from the group consisting of xylylenediamine, 4-aminodiphenylamine, 1,4-dimethylphenylenediamine, and mixtures thereof. In one embodiment the aromatic amine may be 4-aminodiphenylamine.

The process described above to prepare the anthranilic derivative may be carried out at a reaction temperature in the range of 20° C. to 180° C., or 40° C. to 110° C. The process may or may not be carried out in the presence of a solvent. Examples of a suitable solvent include water, diluent oil, benzene, t-butyl benzene, toluene, xylene, chlorobenzene, hexane, tetrahydrofuran, or mixtures thereof. The reactions may be performed in either air or an inert atmosphere. Examples of suitable inert atmosphere include nitrogen or argon, typically nitrogen.

Carboxylic Functionalised Polymer

The amine-functionalised additive may be the reaction product of the amine having at least 3 or 4 aromatic groups with a carboxylic functionalised polymer. The resultant product obtained may be described as being an amine-functionalised carboxylic functionalised polymer.

The carboxylic functionalised polymer backbone may be a homopolymer or a copolymer, provided that it contains at least one carboxylic acid functionality or a reactive equivalent of carboxylic acid functionality (e.g., anhydride or ester). The carboxylic functionalised polymer may have a carboxylic acid functionality (or a reactive equivalent of carboxylic acid functionality) grafted onto the backbone, within the polymer backbone or as a terminal group on the polymer backbone.

The carboxylic functionalised polymer may be a polyisobutylene-succinic anhydride, a maleic anhydride-styrene copolymer, an ester of a maleic anhydride-styrene copolymer, an alpha olefin-maleic anhydride copolymer, or a maleic anhydride graft copolymer of (i) a styrene-ethylene-alpha olefin polymer, (ii) a hydrogenated alkenyl aryl conjugated diene copolymer ((that is, a hydrogenated alkenyl arene conjugated diene copolymer, in particular a hydrogenated copolymer of styrene-butadiene), (iii) a polyolefin grafted with maleic anhydride (in particular ethylene-propylene copolymer), or (iv) a isoprene polymer (in particular non-hydrogenated isobutylene-isoprene copolymer or a hydrogenated styrene-isoprene polymer), or mixtures thereof.

The carboxylic functionalised polymer described herein is known in lubricant technology. For example:

(i) esters of maleic anhydride and styrene-containing polymers are known from U.S. Pat. No. 6,544,935;

(ii) grafted styrene-ethylene-alpha olefin polymers are taught in International publication WO 01/30947;

(iii) copolymers derived from isobutylene and isoprene have been used in preparing dispersants and are reported in International publication WO 01/98387;

(iv) grafted styrene-butadiene and styrene-isoprene copolymers are described in a number of references including DE 3,106,959; and U.S. Pat. Nos. 5,512,192, and 5,429,758;

(v) polyisobutylene succinic anhydrides have been described in numerous publications including U.S. Pat. Nos. 4,234,435; 3,172,892; 3,215,707; 3,361,673; and 3,401,118;

(vi) grafted ethylene-propylene copolymers have been described in U.S. Pat. Nos. 4,632,769; 4,517,104; and 4,780,228;

(vii) esters of (alpha-olefin maleic anhydride) copolymers have been described in U.S. Pat. No. 5,670,462;

(viii) copolymers of isobutylene and conjugated dienes (such as isobutylene-isoprene copolymer) have been described in U.S. Pat. Nos. 7,067,594 and 7,067,594 and US Patent Application US 2007/0293409; and (ix) terpolymers of ethylene, propylene and non-conjugated diene (such as dicyclopentadiene or butadiene) and described in U.S. Pat. Nos. 5,798,420 and 5,538,651.

Typically the polymers mentioned in (iii), (iv) and (viii) that contain dienes e.g., butadiene or isoprene) are partially or wholly hydrogenated.

Many of the polymer backbones are also described in "Chemistry and Technology of Lubricants, Second Edition, Edited by R. M. Mortier and S. T. Orszulik Published by Blackie Academic & Professional. In particular pages 144-180 discuss many of the polymer backbones (i)-(iv) and (vi)-(viii).

The polymer backbone (other than a polyisobutylene) of the present invention may have a number average molecular weight (by gel permeation chromatography, polystyrene standard), which may be up to 150,000 or higher, e.g., 1,000 or 5,000 to 150,000 or to 120,000 or to 100,000. An example of a suitable number average molecular weight range includes 10,000 to 50,000, or 6,000 to 15,000, or 30,000 to 50,000. In one embodiment, the polymer backbone has a number average molecular weight of greater than 5,000, for instance, greater than 5000 to 150,000. Other combinations of the above-identified molecular weight limitations are also contemplated.

When the polymer backbone of the invention is a polyisobutylene, its number average molecular weight (by gel permeation chromatography, polystyrene standard), may be 350 to 5000, or 550 to 3000 or 750 to 2500.

(Thus, a polyisobutylene succinic anhydride may be derived from a polyisobutylene with any of the foregoing molecular weights.) Commercially available polyisobutylene polymers have a number average molecular weight of 550, 750, 950-1000, 1550, 2000, or 2250. Some of the commercially available polyisobutylene polymers may obtain the number average molecular weights shown above by blending one or more polyisobutylene polymers of different weights.

In one embodiment the product may be obtained/obtainable by reacting a carboxylic functionalised polymer with an amine-functionalised additive having at least 3 or 4 aromatic groups, at least one —$NH_2$ functional group, and at least 2 secondary or tertiary amino groups.

The amine-functionalised additive having at least 3 or 4 aromatic groups may be reacted with the carboxylic functionalised polymer under known reaction conditions. The reaction conditions are known to a person skilled in the art for forming imides and/or amides of carboxylic functionalised polymers.

The amine-functionalised carboxylic functionalised polymer obtained/obtainable by reacting a carboxylic functionalised polymer with an amine having at least 3 or 4 aromatic groups, at least one —$NH_2$ functional group, and at least 2 secondary or tertiary amino groups may in certain embodiment be represented by the Formulae (4) and/or (5):

Formula (4)

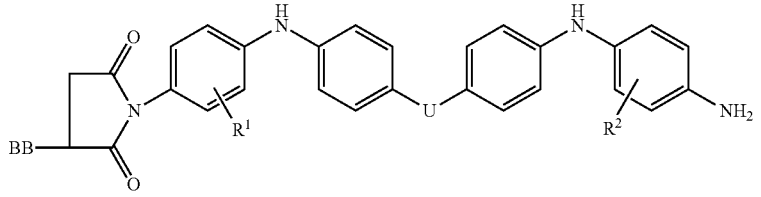

-continued

Formula (5)

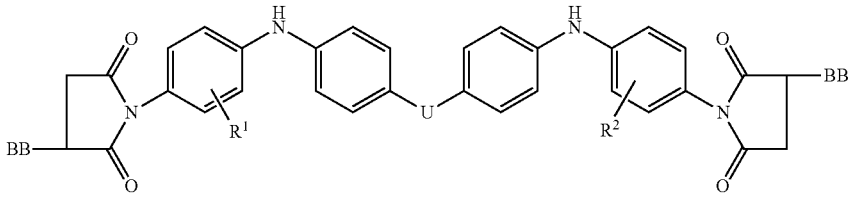

wherein independently each variable, $R^1$, $R^2$ and U are described previously;

BB may be a polymer backbone and may be polyisobutylene, or copolymers of (i) hydrogenated alkenyl aryl conjugated diene copolymers (in particular hydrogenated copolymers of styrene-butadiene), (ii) polyolefins (in particular ethylene-alphaolefins such as ethylene-propylene copolymers), (iii) hydrogenated isoprene polymers (in particular hydrogenated styrene-isoprene polymers), or (iv) a copolymer of isoprene and isobutylene. BB may be substituted with one succinimide group as is shown in formulae (4) and (5), or it may be substituted by multiple succinimide groups. In one embodiment BB may be a copolymer of isoprene and isobutylene.

In addition to formulae (4) and (5), additional structures may also be formed including trimers, tetramers, higher-mers or mixtures thereof. The amino groups shown in Formulae (4) and (5) may also be replaced, in whole, or in part, by the amine of formulae (2a), (3), (3a), or mixtures thereof.

When BB may be polyisobutylene the resultant carboxylic functionalised polymer may typically be polyisobutylene succinic anhydride. Typically w, as defined in Formula (1) may be 1 to 5, or 1 to 3.

When BB may be other than polyisobutylene, and has maleic anhydride (or other carboxylic acid functionality) grafted thereon, one or more of the grafted maleic anhydride groups may be a succinimide of the amine of the invention upon reaction with the amine. The number of succinimide groups may be 1 to 40, or 2 to 40, or 3 to 20.

The amine-functionalised carboxylic functionalised polymer may be obtained/obtainable by reacting a carboxylic functionalised polymer derived from maleic anhydride-styrene copolymers, esters of maleic anhydride-styrene copolymers, alpha-olefin maleic anhydride copolymers; or mixtures thereof with an amine having at least 3 or 4 aromatic groups, at least one —$NH_2$ functional group, and at least 2 secondary or tertiary amino groups. Typically the product of this type may be described as an alternating copolymer. Within the alternating copolymer one or more of the maleic anhydride derived groups may have a group represented by Formula (6):

Formula (6)

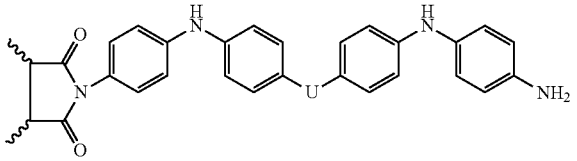

wherein $R^1$, $R^2$ and U are described previously, and the group of Formula (6) may be bonded to components of the polymer backbone through one or both wavy bonds as shown on the maleic ring structure above. When only one wavy bond is bonded to the polymer, the second wavy bond may be to a hydrogen.

The amine containing group in formula (6) may also be replaced by the amine in formula (3), or mixtures thereof.

In one embodiment the amine-functionalised carboxylic functionalised polymer may be derived from a polyisobutylene polymer backbone (represented by PIB in formula 7 below). A more detailed description of the polyisobutylene polymer backbone is described previously in the description.

An example of suitable structures of the anthranilic derivative derived from polyisobutylene, the anthranilic derivative and 4-aminodiphenylamine may be represented by Formula (7):

Formula (7)

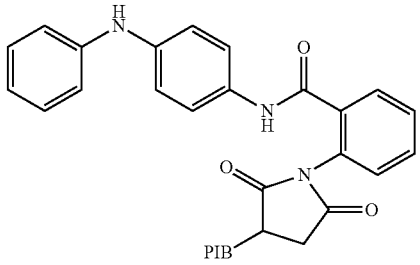

In one embodiment the amine-functionalised carboxylic functionalised polymer may be derived from one of the aromatic amines and from a non-polyisobutylene polymer backbone. Examples of suitable structures of the anthranilic derivative derived from 4-aminodiphenylamine may be represented by Formula (8):

Formula (8)

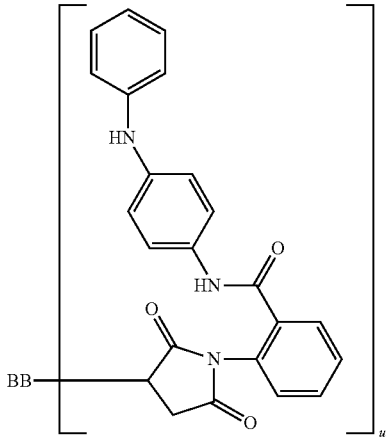

wherein BB may be a polymer (typically BB may be an ethylene-propylene copolymer derived from ethylene-propylene copolymers). As shown BB is grafted with maleic anhydride and functionalised to form the imide group, and u is the number of grafted units within [ ], typically u may be in the range of 1 to 2000, or 1 to 500, or 1 to 250, or 1 to 50, 1 to 20, 1 to 10, or 1 to 4.

A more detailed description of the amine-functionalised carboxylic functionalised polymer is described in International Application PCT/US2008/082944 (based on U.S. Provisional Application 60/987,499), in particular see [0013] to [0021], [0027] to [0091] and the preparative examples 1 to 25 disclosed in paragraphs [0111] to [0135]. The disclosure provides an in-depth discussion on possible structures and methods of preparation of the amine-functionalised carboxylic functionalised polymer.

Further Reaction with Polyamines

In one embodiment additional polyamines or monoamines may optionally be present within the structure of the amine-functionalised additive. The additional polyamines or monoamines may assist in controlling the total acid number (TAN) of the amine-functionalised additive.

Reaction of the amine-functionalised additive (i.e., aromatic amine carboxylic functionalised polymer) with additional polyamines having two or more reactive sites may be possible and useful as long as the carboxylic acid functionality may be low enough or the polyamine charge may be high enough to avoid significant crosslinking of the polymer as evidenced by gellation, incompatibility or poor oil solubility. Alternatively, a skilled person may use enough mono- or capping amine in combination with the polyamine to avoid gellation, incompatibility or poor oil solubility.

Examples of suitable polyamines include ethylenediamine, 1,2-diaminopropane, N-methylethylenediamine, N-tallow ($C_{16}$-$C_{18}$)-1,3-propylenediamine, N-oleyl-1,3-propylenediamine, polyethylenepolyamines (such as diethylenetriamine, triethylenetetramine, tetraethylenepentamine and "polyamine bottoms" (or "alkylenepolyamine bottoms")). In one embodiment the polyamine includes polyalkylenepolyamines. And an additive derived from one of the polyamines of Formula (1) is believed to have dispersant properties.

In general, alkylenepolyamine bottoms may be characterised as having less than 2%, usually less than 1% (by weight) material boiling below about 200° C. at one atmosphere pressure. A typical sample of such ethylene polyamine bottoms may be obtained from the Dow Chemical Company of Freeport, Texas designated "HPA-X™", or from Huntsman as "E-100™". These alkylenepolyamine bottoms may be prepared using an ethylene dichloride process.

Alternatively, capping amines (i.e. monoreactive, monocondensing, non-crosslinking) may be used alone or used in combination with non-capping polyamines.

Capping Polymer with an Amine

Optionally the amine-functionalised additive may further react with a capping amine, or mixtures thereof. The capping amine may be used to modify the total acid number (herein after referred to as TAN) (typically a reduction in TAN) of the amine-functionalised additive of the invention. The capping amine may, if necessary, cap unreacted carboxylic groups in an amount to minimise any detrimental impact on other additives, e.g., detergent. The detrimental impact may include an interaction between the amine-containing additive and the detergent, resulting in formation of a gel. In one embodiment the amine-functionalised additive may be further reacted with a capping amine. In one embodiment the amine-functionalised additive is not further reacted with a capping amine.

In one embodiment the capping amine may be selected from the group consisting of dimethylaminopropylamine, aniline, 4-aminodiphenylamine, benzylamine, phenethylamine, 3,4-dimethoxyphenethylamine, 1,4-dimethylphenylenediamine, and mixtures thereof. Some of these and other capping amines may also impart antioxidant performance to the polymers, in addition to dispersancy and other properties.

In one embodiment the capping amine may be selected from the group consisting of dimethylaminopropylamine, aniline, 4-aminodiphenylamine, 1,4-dimethylphenylenediamine, and mixtures thereof.

The capping process may be carried out at a reaction temperature in the range of 40° C. to 180° C., or 50° C. to 170° C.

The reaction may or may not be carried out in the presence of a solvent. Examples of a suitable solvent include diluent oil, benzene, t-butyl benzene, toluene, xylene, chlorobenzene, hexane, tetrahydrofuran, or mixtures thereof.

The reaction may be preformed in either air or an inert atmosphere. Examples of suitable inert atmosphere include nitrogen or argon, typically nitrogen.

A more detailed description of capping amines is described in U.S. Patent Application 61/118,012 on page 13, paragraph [0058] to page 21, paragraph [0088].

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Catagories". In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives include at least one of metal deactivators, viscosity modifiers, detergents, friction modifiers, antiwear agents, corrosion inhibitors, dispersants (other than the dispersant of present invention as described above), dispersant viscosity modifiers (other than the amine-functionalised additive of present invention as described above), extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of an antiwear agent, a dispersant viscosity modifier, a friction modifier, a viscosity modifier, an antioxidant, an overbased detergent, or mixtures thereof.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008]).

The dispersant viscosity modifier of U.S. Pat. No. 4,863,623 may be described as being prepared by grafting of an olefinic carboxylic acid acylating agent onto a polymer of 15 to 80 mole percent of ethylene, from 20 to 85 mole percent of $C_{3-10}$ alpha monoolefin, and from 0 to 15 mole percent of non-conjugated diene or triene, said polymer having an average molecular weight ranging from 5000 to 500,000, and further reacting said grafted polymer with an amine. The polymer is reacted with at least one olefinic carboxylic acid acylating agent to form one or more acylating reaction intermediates having a carboxylic acid acylating function and the additive is formed by reacting said reaction intermediate with an amine such as an amino-aromatic polyamine compound selected from an N-arylphenylenediamine, an aminothiazole, an aminocarbazole, an aminoindole, and aminopyrrole, an amino-indazolinone, an aminomercaptotriazole, and an aminopyrimidine.

The dispersant viscosity modifier of International Publication WO2006/015130 may be described as a reaction product of: (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with said carboxylic acid functionality to provide a pendant group and at least one additional group comprising at least one nitrogen, oxygen, or sulfur atom, wherein said aromatic amine is selected from the group consisting of (i) a nitro-substituted aniline, (ii) amines comprising two aromatic moieties linked by a —C(O)NR— group, a —C(O)O— group, an —O— group, an —N═N— group, or an —$SO_2$— group where R is hydrogen or hydrocarbyl, one of said aromatic moieties bearing said condensable amino group, (iii) an aminoquinoline, (iv) an aminobenzimidazole, (v) an N,N-dialkylphenylenediamine, and (vi) a ring-substituted benzylamine. Typically the polymer of WO2006/015130 may be an ethylene-propylene copolymer or a copolymer of ethylene and a higher olefin, wherein the higher olefin is an alpha-olefin having 3 to 10 carbon atoms. The dispersant viscosity modifier of International Publication WO2006/015130 is prepared as disclosed in paragraphs [0065] to [0073] (these paragraphs relate to examples 1 to 9).

In one embodiment the friction modifier may be selected from the group consisting of long chain fatty acid derivatives of amines, long chain fatty esters (that is, derivatives of long chain fatty acids with alcohols), or long chain fatty epoxides (or derivatives of long chain fatty acids with epoxides); fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 15 wt %, or 0.1 wt % to 10 wt %, or 0.5 wt % to 5 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulphur containing phenates, sulphur containing phenates, sulphonates, salixarates, salicylates, and mixtures thereof. Typically an overbased detergent may be a sodium, calcium or magnesium salt of the phenates, sulphur containing phenates, sulphonates, salixarates and salicylates. Overbased phenates and salicylates, typically have a total base number of 180 to 450 TBN. Overbased sulphonates typically have a total base number of 250 to 600, or 300 to 500. Overbased detergents are known in the art. The overbased detergent may be present at 0 wt % to 15 wt %, or 0.1 wt % to 10 wt %, or 0.2 wt % to 8 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulphurised olefins, alkylated diphenylamines (typically dinonyl diphenylamine, octyl diphenylamine, dioctyl diphenylamine), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable friction modifiers include long chain fatty acid derivatives of amines, with alcohols, or with epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and a fatty aliphatic carboxylic acid.

In one embodiment the friction modifier may be a long chain fatty acid ester. In another embodiment the long chain fatty acid ester may be a mono-ester and in another embodiment the long chain fatty acid ester may be a (tri)glyceride.

Other performance additives such as corrosion inhibitors include those described in paragraphs 5 to 8 of US Application U.S. Ser. No. 05/038,319, published as WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Dispersant | 0.05 to 12 | 0.75 to 8 | 0.5 to 6 |
| Amine-functionalised Additive | 0.05 to 12 | 0.75 to 8 | 1 to 6 |
| Dispersant Viscosity Modifier | 0 to 5 | 0 to 4 | 0.05 to 2 |
| Overbased Detergent | 0 to 15 | 0.1 to 10 | 0.2 to 8 |

-continued

| | Embodiments (wt %) | | |
|---|---|---|---|
| Additive | A | B | C |
| Antioxidant | 0 to 15 | 0.1 to 10 | 0.5 to 5 |
| Antiwear Agent | 0 to 15 | 0.1 to 10 | 0.5 to 5 |
| Friction Modifier | 0 to 6 | 0.05 to 4 | 0.1 to 2 |
| Viscosity Modifier | 0 to 10 | 0.5 to 8 | 1 to 6 |
| Other Performance Additives | 0 to 10 | 0 to 8 | 0 to 6 |
| Oil of Lubricating Viscosity | Balance to 100% | Balance to 100% | Balance to 100% |

INDUSTRIAL APPLICATION

The lubricating composition may be utilised in an internal combustion engine. The internal combustion engine may or may not have an Exhaust Gas Recirculation system.

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulphated ash content may be 0.05 wt % to 0.9 wt %, or 0.1 wt % to 0.2 wt % or to 0.45 wt %.

In one embodiment the lubricating composition may be an engine oil, wherein the lubricating composition may be characterised as having at least one of (i) a sulphur content of 0.5 wt % or less, (ii) a phosphorus content of 0.1 wt % or less, and (iii) a sulphated ash content of 1.5 wt % or less.

The following examples provide illustrations of the invention. These examples are non-exhaustive and are not intended to limit the scope of the invention.

Examples

Preparative Example 1 (EX1) is the same as preparative example 8 of International Application PCT/US2008/082944 (based on U.S. Provisional Application 60/987,499). A solution of aminodiphenylamine in toluene is charged with isatoic anhydride such that the aminodiphenylamine and isatoic anhydride are in a 1:1 ratio, heated to reflux temperature under a nitrogen atmosphere, and stirred for 6 hours. After cooling the resultant product is isolated via filtration yielding a product (dark-blue powder).

A 2-L, 4-neck flask equipped with an overhead stirrer, thermowell, subsurface inlet with nitrogen line, and Dean-Stark trap with condenser is charged with 3000 g conventional polyisobutylene succinic anhydride (polyisobutylene has a number average molecular weight of 2000) and 3507 g diluent oil and heated to 110° C. 539 g of the dark-blue powder prepared above is added and the temperature increased to 155° C. and held for 6 hours. The product is filtered, giving a viscous oil with a nitrogen content of 1.07 wt % and a yield of 6629 g.

Preparative Example 2 (EX2) is the same as preparative example 2 of U.S. Provisional Application 61/118,012. 500 ml of 2M hydrochloric acid is added to a one-liter 4-neck flask equipped with an overhead stirrer, thermowell, addition funnel with nitrogen line, and condenser. 184.2 g of 4-aminodiphenylamine is added, and the flask is heated to 75° C. The addition funnel is then charged with 40.5 g of a 37% formaldehyde solution and the solution is added dropwise to the flask over a period of 30 minutes. The flask is maintained at 100° C. for 4 hours. The flask is then cooled to ambient temperature. 80 g of a 50/50 wt/wt solution of sodium hydroxide in water is added over 30 minutes. At the end of the reaction, a solid product is obtained via filtration.

A three-liter, 4-neck flask equipped with an overhead stirrer, thermowell, subsurface inlet with nitrogen line, and Dean-Stark trap with condenser is charged with polyisobutylene succinic anhydride (1270.0 g) (where the polyisobutylene has a number average molecular weight of 2000) and diluent oil (1400.1 g). The flask is heated to 90° C. The solid product (442.0 g) is then added slowly. The temperature is then raised to 110° C. and held until water is removed. The temperature is then raised to 160° C. and held for 10 hours. To the flask is added a portion of a diatomaceous earth filter aid, and then flask contents are filtered through a second portion of the diatomaceous earth filter aid. The resultant product is a dark oil with a nitrogen content of 0.65 wt %.

SAE 15W-40 Engine Lubricants

A series of SAE 15W-40 engine lubricants are prepared containing 1.3 wt % of antioxidants (mixture of sulphurised olefins, hindered phenols and alkylated diphenylamines), 1 wt % of zinc dialkyldithiophosphate, 2.8 wt % of a mixture of detergents (including calcium sulphonate and calcium phenate). The lubricants also contain specified amounts of a succinimide dispersant and either the product of preparative example 1 or preparative example 2. The amounts of succinimide dispersant and the products of preparative examples 1 and 2 are shown in the following table:

| | CE1 | EX1 | EX2 | EX3 | EX4 | CE2 |
|---|---|---|---|---|---|---|
| succinimide dispersant (wt %) | 10.2 | 8.2 | 6.1 | 4.1 | 2 | 0 |
| wt % of Prep1 | 0 | 2 | 4.1 | 6.1 | 8.2 | 10.2 |
| | CE3 | EX5 | EX6 | EX7 | EX8 | CE4 |
| succinimide dispersant (wt %) | 0 | 2 | 4.1 | 6.1 | 8.2 | 10.2 |
| wt % of Prep2 | 10.2 | 8.2 | 6.1 | 4.1 | 2 | 0 |

Footnote:
CE1, CE2, CE3 and CE4 are comparative SAE 15W-40 lubricant examples.
The succinimide dispersant is quoted in an amount that includes 50 wt % of diluent oil
The product of Prep1 and Prep2 is quoted in an amount that includes 50 wt % of diluent oil Soot Test The lubricants are evaluated in a soot test. The lubricants are stressed by addition of 1 vol % of a 17.4 M mixture of sulphuric and nitric acid (10:1) (amount of acid calculated to reduce TBN by 11). The acid stressed samples are top treated with 6 wt % carbon black (soot model) and 5 wt % diesel fuel. The lubricant mixture is the homogenised in a tissumizer to make a slurry. The slurry is then sonicated to completely disperse the carbon black. The dispersed sample is stored at 90° C. for 7 days while blowing 0.5 cc $min^{-1}$ of 0.27% nitrous oxide in air through the sample. 25 microliter aliquots of sample are blotted onto chromatography paper once daily. After curing the filter paper for 2 hours at 90° C., the ratio of the diameter of the internal carbon black containing spot to the external oil spot is measured, averaged over 7 days and reported in the table as soot ratio. Higher soot ratio indicates improved soot dispersion. The results obtained are as follows:

| | CE1 | EX1 | EX2 | EX3 | EX4 | CE2 |
|---|---|---|---|---|---|---|
| Soot Ratio | 36 | 39 | 78 | 80 | 79 | 82 |
| | CE3 | EX5 | EX6 | EX7 | EX8 | CE4 |
| Soot Ratio | 62 | 80 | 81 | 80 | 80 | 36 |

The results indicate that high soot ratio correlates to better soot dispersion. When a highly efficient treat rate of the dispersant and amine-functionalised additive are used in combination high soot ratios are observed.

Mack T-11 Test

A series of SAE 15W-40 lubricants are prepared similar to those described above, except the amount of succinimide dispersant and product of preparative examples 1 and 2 are shown in the following table:

| | CE5 | EX9 | EX10 | EX11 |
|---|---|---|---|---|
| succinimide dispersant (wt %) | 8.2 | 4.1 | 4 | 4 |
| wt % of Prep1 | 0 | 0 | 0 | 7 |
| wt % of Prep2 | 0 | 4.1 | 7 | 0 |

Footnote:
CE5 is a SAE 15W-40 lubricant.
EX9 further contains 2 wt % of dispersant viscosity modifier derived from an ethylene-propylene copolymer.

The lubricants are evaluated for Mack T-11 performance by methodology described in ASTM standard procedure D7156. Typically better results are obtained for samples having higher soot content at the point of 12 $mm^2/s$ (cSt) viscosity increase. The results obtained are:

| | CE5 | EX9 | EX10 | EX11 |
|---|---|---|---|---|
| % Soot at 12 $mm^2/s$ (cSt) viscosity increase | 4.9 | >7.35 | >7.68 | >7.53 |

Seal Data

The SAE 15W-40 lubricants are then evaluated in a seal test to evaluate tensile strength and rupture elongation of a AK6 Viton® seal. The evaluation is carried out by the methodology described in the Mercedes-Benz supply specification (MB DBL 6674). The seal tensil strength and rupture elongation results obtained are:

| | CE5 | EX9 | EX10 | EX11 |
|---|---|---|---|---|
| % Tensile Elongation | −51.3 | −27.3 | −29.9 | −4.9 |
| % Rupture Elongation | −41.6 | −26.5 | −31.9 | −16.9 |

The data presented indicates that the lubricating composition of the invention is able to alleviate soot-mediated oil thickening whilst being compatible with seals. The smaller absolute numbers indicate less damage to the seals by the lubricating composition.

It is known that some of the materials described above may interact in the final formulation, so that the components of the final formulation may be different from those that are initially added. The products formed thereby, including the products formed upon employing lubricant composition of the present invention in its intended use, may not be susceptible to easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity, a polyisobutylene succinimide dispersant, a dispersant viscosity modifier and an amine-functionalised additive, wherein the polyisobutylene succinimide dispersant is derived from a polyisobutylene having a molecular weight or 750 to 2500, wherein the amine-functionalised additive is derived from an amine having at least 3 aromatic groups, the amine having at least 3 aromatic groups selected from the group consisting of a) amines represented by the formula:

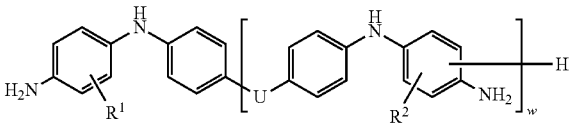

wherein independently each variable $R^1$ is hydrogen or a $C_{1-5}$ alkyl group;

$R^2$ is hydrogen or a $C_{1-5}$ alkyl group;

U is an aliphatic, alicyclic or aromatic group, with the proviso that when U is aliphatic, the aliphatic group may be a linear or branched alkylene group containing 1 to 5 carbon atoms; and w is 1 to 10:

b) bis[p-(p-aminoanilino)phenyl]-methane, 2-(7-aminoacridin-3-ylmethyl)-N-4-{4-[4-(4-amino-phenylamino)-benzyl]-phenyl}-benzene-1,4-diamine, or mixtures thereof, and c) amines obtained/obtainable by a process comprising reacting: (1) isatoic anhydride or alkyl substituted isatoic anhydride and (2) an aromatic amine with at least two aromatic groups and a primary or a reactive secondary amino group, wherein the amine-functionalised additive is a product obtained by reacting the amine having at least 3 aromatic groups with a carboxylic functionalised polymer, and wherein the dispersant viscosity modifier is either:

prepared by grafting of an olefinic carboxylic acid acylating agent onto a polymer of 15 to 80 mole percent of ethylene, from 20 to 85 mole percent of $C_{3-10}$ alpha monoolefin, and from 0 to 15 mole percent of non-conjugated diene or triene, said polymer having an average molecular weight ranging from 5000 to 500,000, and further reacting said grafted polymer with an amine, or a reaction product of: (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with said carboxylic acid functionality to provide a pendant group and at least one additional group comprising at least one nitrogen, oxygen, or sulfur atom, wherein said aromatic amine is selected from the group consisting of (i) a nitro-substituted aniline, (ii) an amine comprising two aromatic moieties linked by a —C(O)NR— group, a —C(O)O— group, an —O— group, an —N=N— group, or an —$SO_2$— group where R is hydrogen or hydrocarbyl, one of said aromatic moieties bearing said condensable amino group, (iii) an aminoquinoline, (iv) an aminobenzimidazole, (v) an N,N-dialkylphenylenediamine, and (vi) a ring-substituted benzylamine.

2. The lubricating composition of claim 1, wherein the amine-functionalised additive is derived from an amine having at least 4 aromatic groups, at least one —$NH_2$ functional group, and at least 2 secondary or tertiary amino groups.

3. The lubricating composition of 1, wherein the carboxylic functionalised polymer is a polyisobutylene succinic anhydride.

4. The lubricating composition of claim 3, wherein the polyisobutylene succinic anhydride is derived from a polyisobutylene with number average molecular weight of 350 to 5000.

5. The lubricating composition of claim 1, wherein the carboxylic functionalised polymer is a hydrogenated copolymer of styrene-butadiene.

6. The lubricating composition of claim 1, wherein the carboxylic functionalised polymer is an ethylene-propylene copolymer with maleic anhydride.

7. The lubricating composition of claim 1, wherein the carboxylic functionalised polymer is a hydrogenated styrene-isoprene polymer.

8. The lubricating composition of claim 1, wherein the succinimide dispersant is derived from an aliphatic polyamine, or mixtures thereof.

9. The lubricating composition of claim 8, wherein the aliphatic polyamine is an ethylenepolyamine, a propylenepolyamine, a butylenepolyamine, or mixtures thereof.

10. The lubricating composition of claim 8, wherein the aliphatic polyamine is selected from the group consisting of ethylenediamine, diethylenetriamine, triethylenetetramine, tetraethylenepentamine, pentaethylenehexamine, polyamine still bottoms, and mixtures thereof.

11. The lubricating composition of claim 1, wherein the lubricating composition is characterised as having (i) a sulphur content of 0.5 wt % or less, (ii) a phosphorus content of 0.1 wt % or less, and (iii) a sulphated ash content of 1.5 wt % or less.

12. The lubricating composition of claim 1 further comprising at least one of an antiwear agent, a dispersant viscosity modifier, a friction modifier, a viscosity modifier, an antioxidant, an overbased detergent, or mixtures thereof.

13. The lubricating composition of claim 1, wherein the amine-functionalised additive is derived from an amine having at least 4 aromatic groups.

14. The lubricating composition of claim 1, wherein the polyisobutylene succinimide dispersant has a carbonyl to nitrogen ratio of 1:1 to 1:1.3.

15. A method of lubricating an internal combustion engine comprising supplying to the internal combustion engine the lubricating composition of claim 1.

* * * * *